US006011469A

United States Patent [19]

Taft et al.

[11] Patent Number: 6,011,469

[45] Date of Patent: Jan. 4, 2000

[54] OVERHEAD DOOR POSITION SENSOR MOUNTING DEVICE

[75] Inventors: Mark S. Taft, Milwaukie; Victor L. Bartholomew, Tigard; Scott A. Ackley, Portland, all of Oreg.

[73] Assignee: SLC Technologies, Inc., Tualatin, Oreg.

[21] Appl. No.: 09/047,132

[22] Filed: Mar. 24, 1998

[51] Int. Cl.[7] ..... G08B 13/08

[52] U.S. Cl. ..... 340/547; 49/13; 248/231.41; 248/231.61; 340/545.1

[58] Field of Search ..... 340/547, 545.1; 49/13; 248/229.24, 231.41, 227.4, 231.61, 228.3, 228.5

[56] References Cited

U.S. PATENT DOCUMENTS

| | | | |
|---|---|---|---|
| 4,752,657 | 6/1988 | Kane et al. | 200/82 E |
| 5,554,833 | 9/1996 | Johnson | 200/61.72 |
| 5,723,835 | 3/1998 | Gilmore | 200/61.71 |

*Primary Examiner*—Glenn Swann
*Attorney, Agent, or Firm*—Stoel Rives LLP

[57] ABSTRACT

An overhead door position sensor assembly includes a sensor actuating device, and a position sensor including a roller track clamping device for mounting the position sensor onto a roller track of an overhead door assembly. The sensor actuating device is mountable to an overhead door of the overhead door assembly for actuating the position sensor when the sensor actuating device is located within a minimum actuation distance from the position sensor. The roller track clamping device includes a body having a main member for placement adjacent to a sidewall of the roller track and a curved resilient member extending from the main member for placement along the contour of a curved roller race that extends from the sidewall of the roller track. A bracket of the roller track clamping device is coupled to the body. A plurality of serrations located on one of the body and bracket engage with an edge of a slot located on the other of the body and the bracket to allow the body and the bracket to be coupled in a ratchet-like manner. The resilient member of the body includes a flexible thin section that conforms to the roller race and prevents the roller track clamping device from slipping along the roller track. When installed, no part of the position sensor assembly interferes with travel of the overhead door along the roller track.

19 Claims, 5 Drawing Sheets

OVERHEAD DOOR POSITION SENSOR MOUNTING DEVICE

TECHNICAL FIELD

The present invention relates to support and mounting brackets for roller track assemblies for sectional overhead doors and the like, and, in particular, to a method and an apparatus for fastenerless mounting of a security system sensor to a roller track of a sectional overhead door assembly.

BACKGROUND OF THE INVENTION

Conventional overhead door assemblies, such as sectional overhead doors and overhead panel doors, are commonly used in residential and commercial garage structures to close a garage opening. Overhead door assemblies of this type include roller tracks positioned adjacent the interior sides of the garage opening and extending from near the floor of the garage toward the level of the top of the garage opening. The roller tracks are designed to guide an overhead door by providing a track for a plurality of rollers to travel, the rollers rotatably mounted along the side edges of the overhead door. Spring, pulley, and cable assemblies are often positioned adjacent the roller tracks and connected at one end to the garage structure and at the other end to the overhead door to counter-balance the weight of the overhead door.

Conventional roller tracks have a C-shaped cross-section and include a sidewall, a curved roller race extending from the sidewall, and a flat flange extending in a direction transverse to the sidewall. The roller race and the flange define an interior area within which the rollers of the overhead door travel, and an opening positioned toward the overhead door. The interior area must be kept free of obstructions that could restrict travel of the rollers along the roller track. In addition, the outer surfaces of the roller race and flange must be kept clear of obstructions near their ends to allow cable and spring assemblies of the overhead door assembly to move freely alongside the roller track.

Mounting brackets, supports, and other devices for securing or attaching to the roller track of an overhead door assembly are commonly attached to the roller track with threaded fasteners or tab-in-slot mechanisms of the type shown and described in U.S. Pat. No. 5,718,533 of Mullet et al. One disadvantage of these methods of attachment is that the fasteners protrude within the interior of the roller track and may hinder the travel of the rollers along the interior of the roller track. Additionally, these arrangements require the person attaching the mounting bracket to align the mounting bracket with pre-fabricated holes or slots in the roller track to connect the mounting bracket and the roller track. The mounting holes and slots are formed in predetermined locations during fabrication of the roller track, which can result in inaccurate placement of mounting holes or slots, or the complete lack of mounting holes where needed.

Many modern commercial and residential security alarm systems employ a sensor for indicating the position of the overhead door along the roller track. The sensor is typically attached, after installation of the overhead door assembly, either to a structural wall near the overhead door or to the roller track. Because overhead door assemblies are typically not designed to accommodate security systems, mounting holes or slots often do not exist at places along the roller track where it would be desirable to mount the sensor. One way to overcome his problem is to drill additional mounting holes in the roller track during or after installation of the roller track. However, this post-manufacture drilling procedure is expensive, time-consuming, and inconvenient.

SUMMARY OF THE INVENTION

An object of the invention is, therefore, to provide a method of attaching a security system sensor to a roller track of an overhead door assembly that does not require a hole in the roller track and that provides a secure connection to a roller track without the use of tools or fasteners.

Another object of the invention is to provide a roller track clamping device that is suitable for housing a magnetically actuated sensor of a security system for detecting the position of the overhead door along the roller track.

A further object of the invention is to provide such a roller track clamping device that is simple and economical, yet will allow a snug and rigid connection to the roller track.

Yet another object of the invention is to provide such a roller track clamping device that is suitable for mounting to roller tracks of different sizes.

Still another object of the invention is to provide such a roller track clamping device that, once connected, is not easily removed from the roller track.

The present invention is an overhead door position sensor assembly that includes a position sensor, a sensor actuating device, and a roller track clamping device for mounting in proximity to a sensor actuating device a position sensor onto a roller track of an overhead door assembly. The roller track clamping device includes a body having a main member for placement adjacent to a sidewall of the roller track and a curved resilient member extending from the main member for placement along the contour of a curved roller race that extends from the sidewall of the roller track. The main member includes an angled portion in which a slot is formed. A bracket of the roller track clamping device includes an outer leg portion sized to extend through the slot, and a jaw extending in a direction transverse to the outer leg portion for contacting a flange of the roller track. In one embodiment, a plurality of serrations provided along the outer leg portion for engagement with an edge of the slot allow the body and the bracket to be coupled together in a ratchet-like manner. The serrations are provided along the outer leg portion of the bracket to allow the roller track clamping device to fit roller tracks of various sizes.

In another embodiment, the angled portion and the slot are formed in the outer leg portion of the bracket, and the serrations are formed on the main member of the body, the main member being sized to extend through the slot in the outer leg portion for a ratchet-like connection.

The resilient member that extends from the main member of the body includes a flexible thin section for conforming to the shape of the roller race of the roller track. The resilient member and the flexible thin section provide a contact area between the resilient member and the roller race that is sufficient to prevent the roller track clamping device from slipping along the roller track when in use. The main member of the body includes a threaded hole holding a locking bolt that may be rotated to further secure the resilient member against the roller race. A mounting notch is provided in the main member of the body for optional connection of the body to the roller track with a fastener instead of the bracket.

The main member of the body includes a tubular sensor housing for containing and protecting the sensor of the overhead door position sensor assembly. In a preferred embodiment the sensor is a magnetically actuated electrical reed switch having signal wires extending through the sensor housing. A pair of plastic endcaps cover the ends of the sensor housing to contain the sensor within the sensor housing and to protect the sensor from physical damage.

The sensor actuating device of the overhead door position sensor assembly is mountable to an overhead door of the overhead door assembly and includes a magnet for actuating the reed switch when the overhead door is positioned so that the sensor actuating device is located within a minimum actuation distance from the sensor. The sensor actuating device includes a multi-faceted mounting plate that allows the sensor actuating device to be mounted at different elevations from the overhead door.

Additional objects and advantages of this invention will be apparent from the following detailed description of preferred embodiments thereof which proceeds with reference to the accompanying drawings.

DETAILED DESCRIPTION OF PREFERRED EMBODIMENTS

Figure 1:
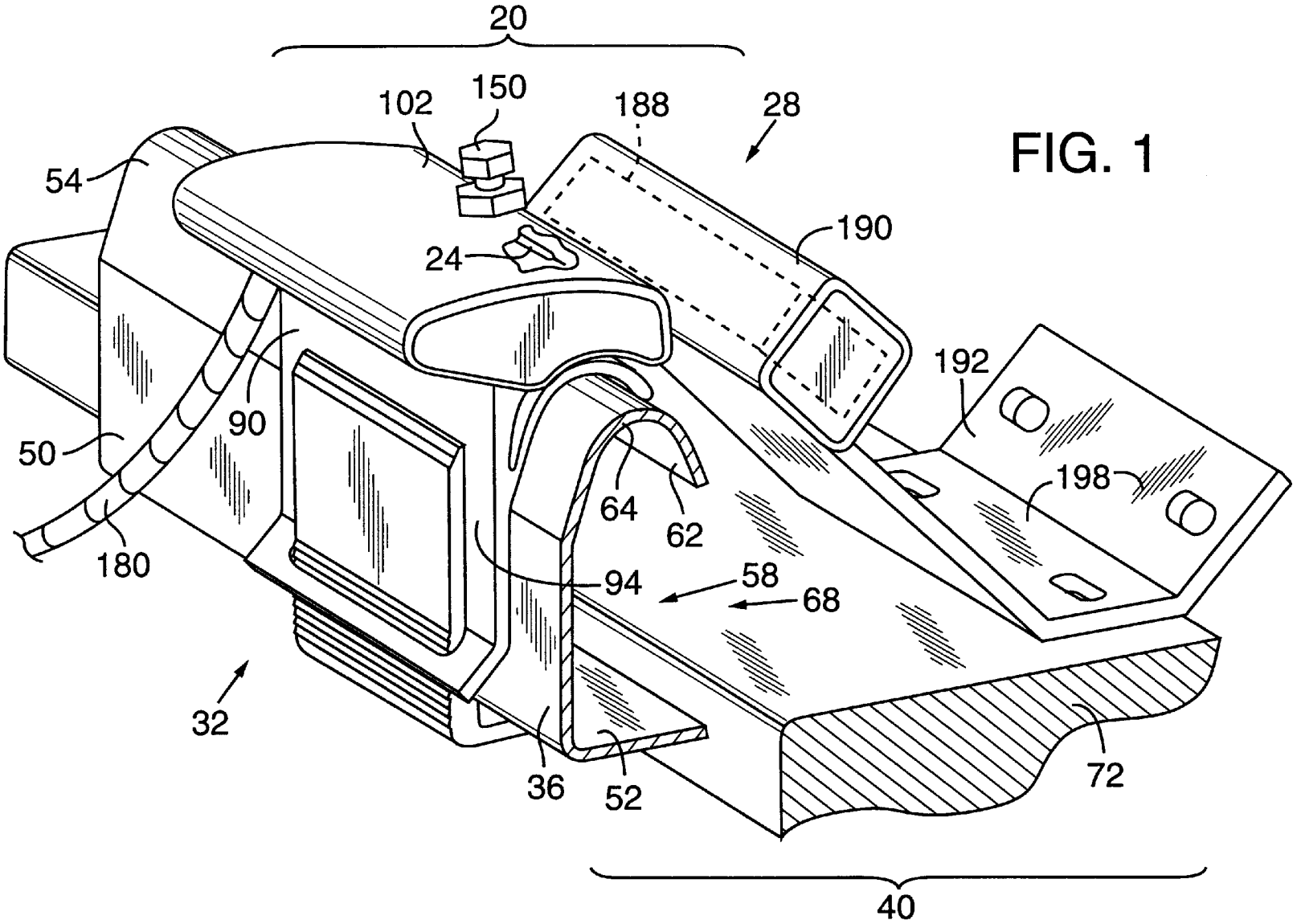
FIG. 1 is a fragmentary perspective view of an assembled and mounted overhead door position sensor assembly in accordance with the present invention.

FIG. 1 shows a pictorial view of a first position sensor assembly 20, which represents a preferred embodiment of the present invention. With reference to FIG. 1, position sensor assembly 20 includes a sensor 24 and a sensor actuating device 28. Sensor 24 is supported by a roller track clamping device 32 for mounting sensor 24 to a roller track 36 of a conventional overhead door assembly 40.

Roller track 36 is an elongate channel having a cross section that is generally C-shaped. Roller track 36 includes a sidewall 50, a flange 52 extending in a direction transverse (preferably at an angle of about 90°) to sidewall 50, and a curved roller race 54 extending from sidewall 50 in opposed relation to flange 52 to define an interior space 58 of roller track 36. Roller race 54 has a free end 62 and an apex 64 located medially of free end 62 and sidewall 50. Free end 62 extends from apex 64 generally toward flange 52 to define an opening 68 between free end 62 and flange 52. An overhead door 72 of overhead door assembly 40 includes rollers 76 (FIGS. 7A and 7B), which are rotatably mounted along the side edges of overhead door 72 and extend through opening 68 so that they may freely travel along roller track 36.

Figure 2:
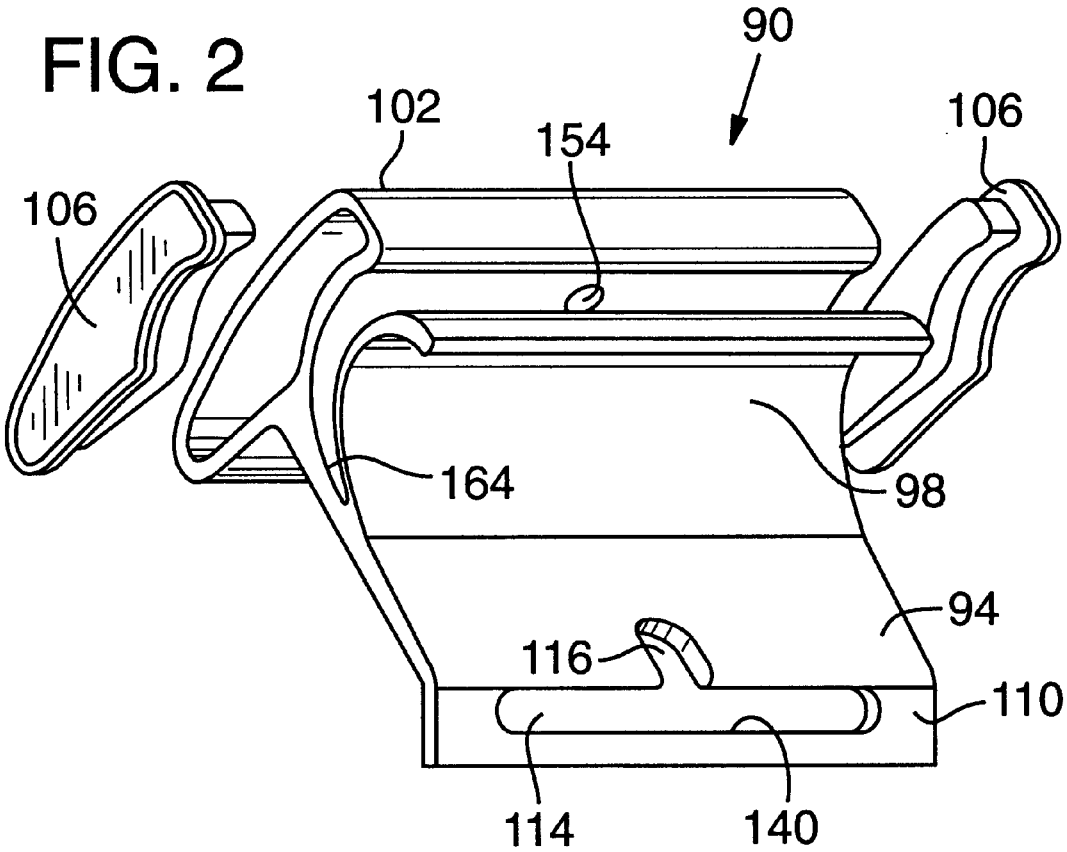
FIG. 2 is an exploded perspective view of the body and endcaps of the position sensor assembly of FIG. 1.
Figure 3:
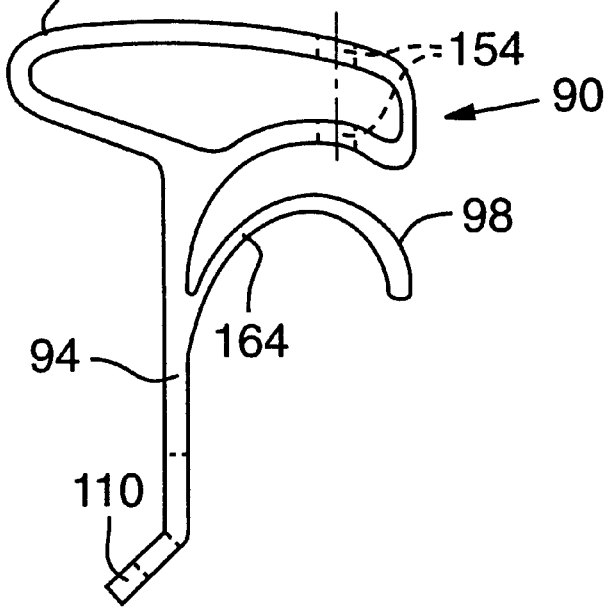
FIG. 3 is a plan view of the body of FIG. 2.

Roller track clamping device 32 includes a body 90 having a main member 94 adapted to be positioned to be adjacent sidewall 50 opposite interior space 58. FIGS. 2 and 3 are, respectively, exploded and top plan views of body 90. With reference to FIGS. 2 and 3, a curved resilient member 98 extends from main member 94 and is shaped to follow the contour of the outside surface of roller race 54. Body 90 includes a tubular sensor housing 102 supported by main member 94 and positioned near resilient member 98. A pair of endcaps 106 covers the ends of sensor housing 102. Main member 94 terminates in an angled portion 110 having a slot 114 oriented for placement parallel to roller track 36. A mounting notch 116 in main member 94 intersects slot 114.

Figure 5:
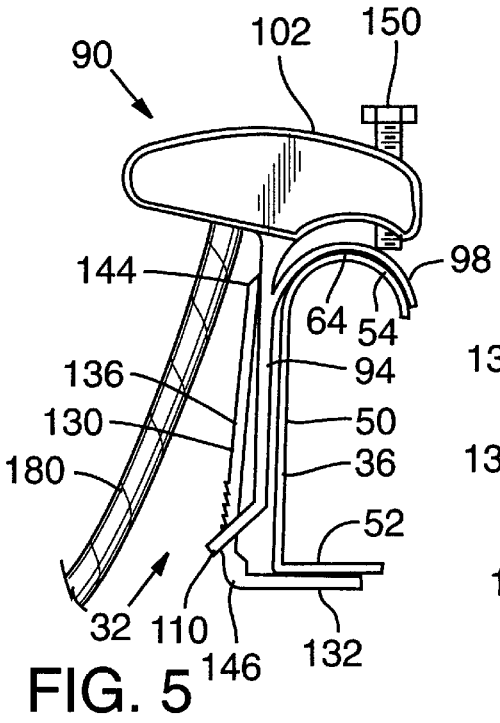
FIG. 5 is a bottom plan view of the body and the bracket of the position sensor assembly of FIG. 1.
Figure 4:
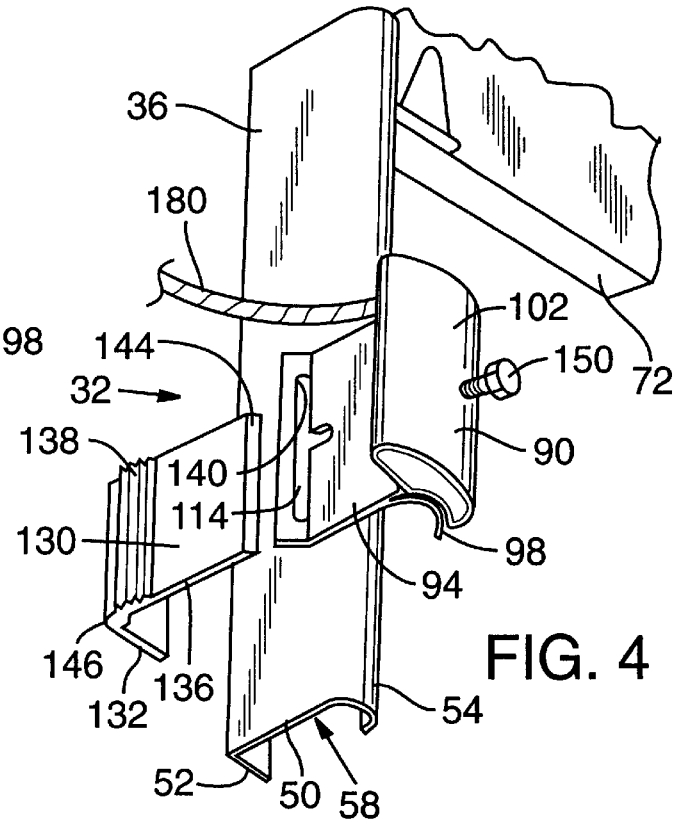
FIG. 4 is an exploded view showing in proper orientation for installation the body and the bracket of the position sensor assembly of FIG. 1.

FIG. 4 is an exploded view of sensor 24 and roller track clamping device 32 in proper orientation for installation. FIG. 5 is a bottom plan view of sensor 24, roller track clamping device 32 and roller track 36. With reference to FIGS. 4 and 5, roller track clamping device 32 includes a bracket 130 having a jaw 132 for contacting flange 52 of roller track 36, and an outer leg portion 136 sized to fit through slot 114 in angled portion 110 of body 90. A plurality of serrations 138 are formed on the surface of outer leg portion 136 for ratchet-like engagement with an edge 140 of slot 114. Bracket 130 includes a bevelled edge surface 144 to facilitate insertion of outer leg portion 136 in slot 114, and a reinforcing fillet 146 where outer leg portion 136 joins jaw 132.

Sensor 24 and its supporting roller track clamping device 32 are installed by positioning body 90 against roller track 36 so that resilient member 98 is adjacent roller race 54 and main member 94 is adjacent sidewall 50 opposite interior space 58. Resilient member 98 is sized to extend beyond apex 64 of roller race 54 in the direction of but without covering free end 62 so that resilient member 98 will not interfere with the movement of overhead door 72. Outer leg portion 136 of bracket 130 is then inserted through slot 114 in angled portion 110 of body 90 so that jaw 132 advances toward flange 52 to clamp roller track 36 between jaw 132 and resilient member 98. Manually pressing bracket 130 toward body 90 flexes resilient member 98 and causes one or more of the serrations 138 to engage edge 140 of slot 114 in ratchet-like fashion for a snug fit. Once clamped together, roller track clamping device 32 fits snugly and securely about roller track 36 and is not easily removed. A locking bolt 150 is threaded through threaded hole 154 (FIG. 2) in sensor housing 102 and may be tightened against resilient member 98 to further secure resilient member 98 against roller race 54.

With reference to FIG. 3, resilient member 98 includes a flexible thin section 164 proximate main member 94. Thin section 164 is approximately 0.045 to 0.055 inch (1.1 to 1.4 mm) thick and curved so that it flexes to closely contour along roller race 54 when roller track clamping device is installed and clamped about roller track 36. When thin section 164 is flexed, the fictional surface contact between resilient member 98 and roller race 54 increases to facilitate a snug and secure fit that will not allow roller track clamping device 32 to slide along roller track 36.

Figure 4A:
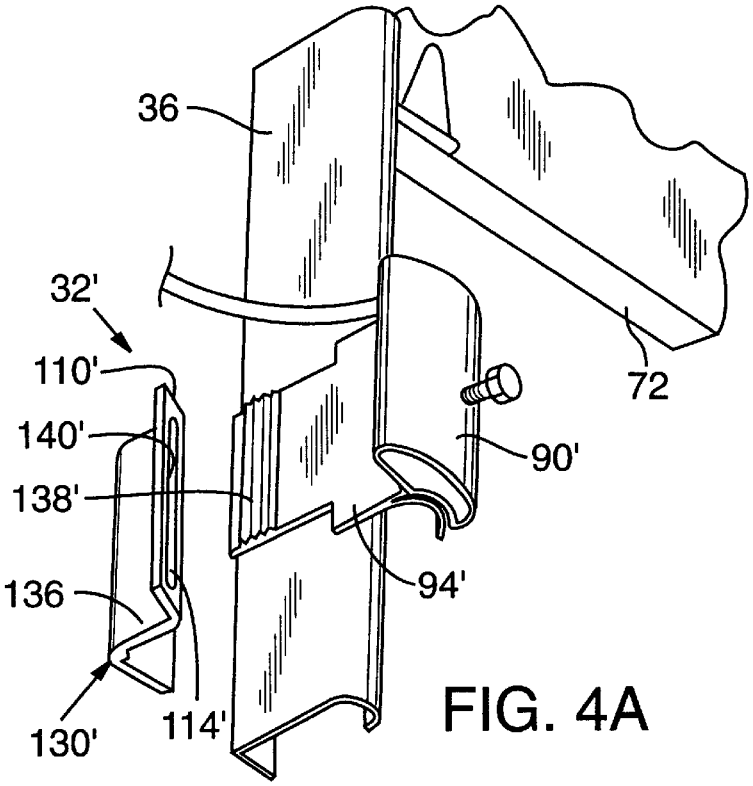
FIG. 4A is an exploded view of an alternative embodiment of the position sensor assembly of FIG. 1.

FIG. 4A is an exploded view of an alternative embodiment roller track clamping device 32'. With reference to FIG. 4A, main member 94' of body 90' includes a plurality of serrations 138' rather than the slot 114 of the first preferred embodiment roller track clamping device 32. Outer leg portion 136' of bracket 130' terminates in angled portion 110', including slot 114' sized to receive main member 94'. Edge 140' of slot 114' engages one or more of the serrations 138' in a manner similar to the first preferred embodiment roller track clamping device 32 when body 90' and bracket 130' are pressed together.

Figure 6:
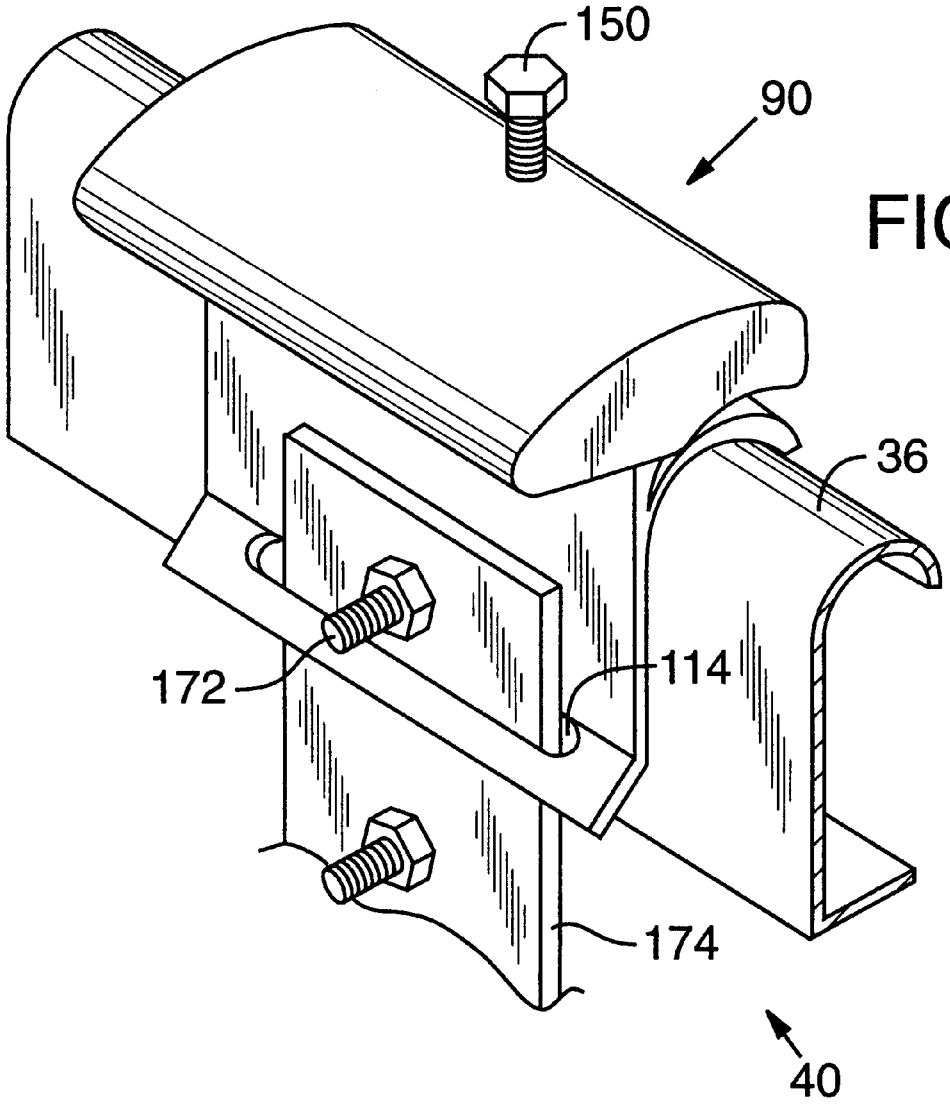
FIG. 6 is the body and sensor of the position sensor assembly of FIG. 1 mounted to a roller track at a roller track support member and without a bracket of the position sensor assembly.

FIG. 6 shows an optional mounting configuration of body 90 to roller track 36. With reference to FIG. 6, a threaded fastener 172 connects roller track 36 and a roller track support member 174 of overhead door assembly 40. Body 90 is placed so that roller track support member 174 extends through slot 114 of body 90 and threaded fastener 172 extends through mounting notch 116 (FIG. 2) to secure body 90 between roller track 36 and roller track support member 174. In this manner, body 90 may be mounted without the use of bracket 130 in places along roller track 36 where it connects to a roller track support member 174.

With reference to FIG. 1, sensor 24 enclosed within sensor housing 102 of body 90 includes electrical signal wires (not shown) that are encased in a flexible armored wire conduit 180 extending from sensor 24 through an aperture (not shown) in sensor housing 102. When sensor and roller track clamping device are installed, wire conduit 180 extends in the direction of a structural wall (not shown) so that wire conduit 180 will not form a loop that would be prone to damage. The signal wires are connected to a security alarm system control unit (not shown).

Sensor 24 is preferably a magnetically actuated single-pole single-throw electrical reed switch having a 15 amp-turn sensitivity. A polyurethane rubber potting compound (not shown) encases sensor 24 to electrically insulate and protect it from damage. Sensor actuating device 28 preferably includes a magnet 188 contained within a magnet enclosure 190 and supported by a multi-faceted mounting plate 192. Magnet 188 is coated with a polyurethane rubber potting compound (not shown) to protect magnet 188 from damage.

Magnet enclosure 190 and body 90, including sensor housing 102, are preferably manufactured of an extruded aluminum alloy such as 6063-T4. Aluminum is durable, strong, and may be machined and formed subsequent to its extrusion. It will not block the magnetic flux of magnet 188, and, thus, will not interfere with the operation of the magnetically actuated reed switch contained within sensor housing 102.

Figure 7A:
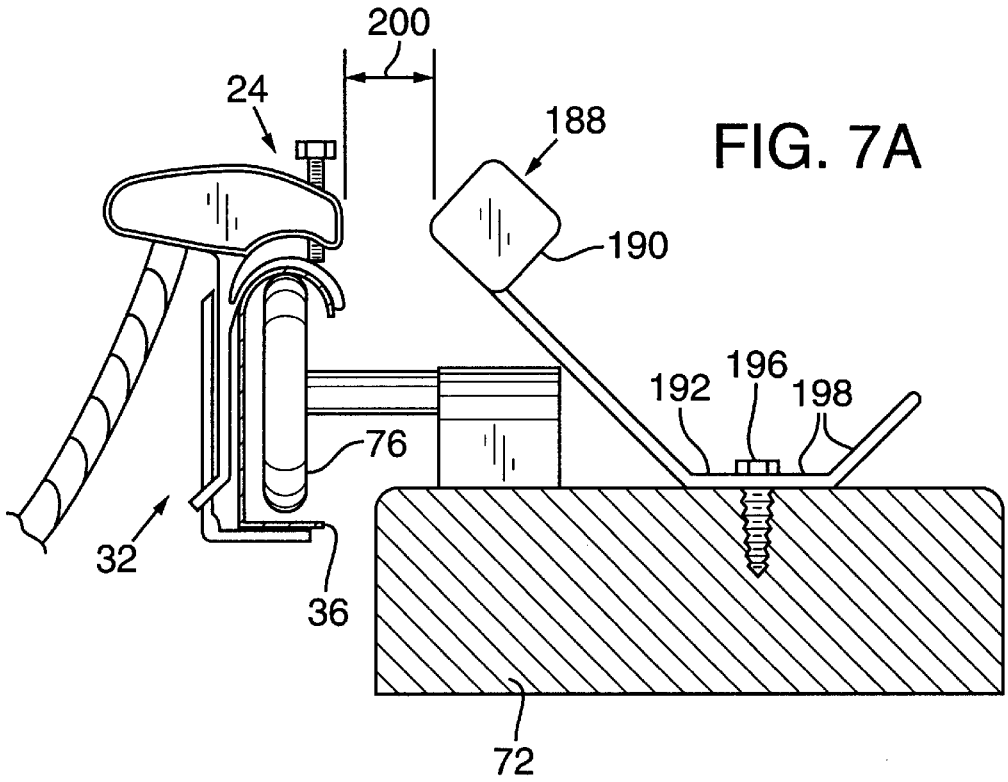
FIGS. 7A and 7B are bottom plan views of the position sensor assembly of FIG. 1 showing the position sensor actuating device in respective first and second mounting configurations.
Figure 7B:
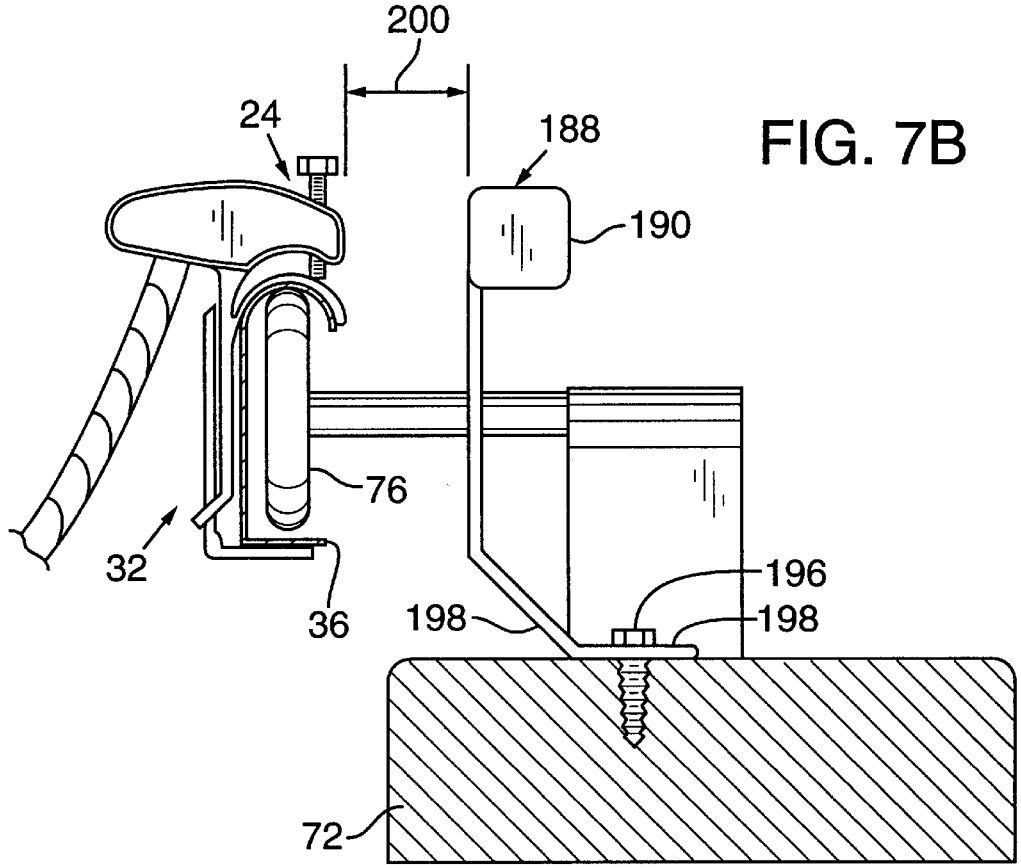

FIGS. 7A and 7B show mounting plate 192 mounted on overhead door 72 in respective first and second mounting configurations. With reference to FIGS. 7A and 7B, mounting plate 192 is attached to overhead door 72 with screws 196. Mounting plate includes multiple faces 198 to allow magnet 188 to be positioned at different elevations from overhead door 72, depending upon the mounting height of rollers 76 on overhead door 72. Sensor actuating device 28 is preferably installed when overhead door 72 is in a closed position such that magnet 188 is positioned adjacent sensor 24 with a gap 200 of 1 to 1.5 inch (2.5–3.8 cm) wide separating magnet 188 and sensor 24. When overhead door 72 is moved so that magnet 188 is positioned beyond a maximum actuation distance of about 3 inches (7.6 cm) from sensor 24, sensor 24 indicates an alarm state that may be received by the security alarm control unit. The actual maximum actuation distance is determined by the design of sensor 24 and the strength of magnet 188.

Roller track clamping device 32 is suitable for mounting other items not otherwise shown or described above, such as proximity switches and light beam sensors. In an embodiment employing a light beam sensor (not shown), a light beam reaches the sensor through an aperture in the sensor housing. The sensor actuating device paired with a light beam sensor would be capable of emitting a light beam or reflecting back to the sensor a light beam emanating from a light beam emitter contained within the sensor housing. Roller track clamping device 32 is also adaptable for mounting support members or other similar items to a roller track 36 without requiring mounting holes in roller track 36.

It will be obvious to those having skill in the art that many changes may be made to the details of the above-described embodiments of this invention without departing from the underlying principles thereof. The scope of the present invention should, therefore, be determined only by the following claims.

We claim:

1. A device for clamping to a roller track, comprising:

a body including a main member and a resilient member extending from the main member; and a bracket having an outer leg portion and a jaw extending in a direction generally transverse to the outer leg portion for clamping a roller track between the jaw and the resilient member, one of the main member of the body and the outer leg portion of the bracket having a slot, and the other of the main member and the outer leg portion sized to fit through the slot and having one or more serrations so that at least one of the serrations may be manually placed in ratchet-like engagement with an edge of the slot for clamping the roller track between the resilient member of the body and the jaw of the bracket in a snug and rigid manner.

2. The device of claim 1 in which:

the roller track includes an open elongate channel having a sidewall, a flange, and a roller race defining an interior space, the flange and the roller race extending from the sidewall and spaced apart in opposed relation to form a unitary structure with the sidewall, the roller race having an apex portion and a free end, the apex portion located medially of the sidewall and the free end, the free end extending from the apex portion generally toward the flange and defining an opening between the free end and the flange;

the body is adapted to be positioned adjacent the roller track with the main member of the body adjacent the sidewall of the roller track opposite the interior space and the resilient member of the body in contact with the roller race opposite the flange; and the resilient member is shaped for generally contouring along the roller race and extending beyond the apex portion of the roller race in the direction of the free end of the roller race without interfering with the interior space or access to the opening of the elongate channel.

3. The device of claim 1 in which the resilient member includes a flexible thin section for substantially conforming to the roller track when the roller track clamping device is clamped between the resilient member and the jaw of the bracket to provide a contact area between the resilient member and the roller track sufficient to prevent the roller track clamping device from slipping along the roller track.

4. The device of claim 1 in which the main member of the body includes a threaded hole and further comprises a threaded member for securing the resilient member against the roller track.

5. The device of claim 1 in which the one of the main member of the body and the outer leg portion of the bracket includes an angled portion in which the slot is located.

6. The device of claim 1 in which the main member includes a hole for receiving a fastener for fastening the body to the roller track.

7. A position sensor assembly for sensing the position of an overhead door guided by a roller track, the roller track including an open side for guiding the overhead door and a closed side opposite the open side, comprising:

a sensor actuating device adapted to be mounted to the overhead door;

a sensor responsive to the sensor actuating device when the sensor actuating device is positioned within a maximum actuation distance from the sensor, the sensor supported by a body, the body having a main member supporting the sensor and a resilient member extending from the main member; and a bracket having an outer leg portion and a jaw extending in a direction generally transverse to the outer leg portion for clamping the roller track between the jaw and the resilient member, one of the main member of the body and the outer leg portion of the bracket having a slot, and the other of the main member and the outer leg portion sized to fit through the slot and having one or more serrations so that at least one of the serrations may be manually placed in ratchet-like engagement with an edge of the slot for clamping the roller track between the resilient portion of the body and the jaw of the bracket in a snug and rigid manner so that no part of the position sensor assembly interferes with travel of the overhead door along the roller track.

8. The position sensor assembly of claim 7 in which:

the roller track includes an open elongate channel having a sidewall, a flange, and a roller race defining an interior space, the flange and the roller race extending from the sidewall and spaced apart in opposed relation to form a unitary structure with the sidewall, the roller race having an apex portion and a free end, the apex portion located medially of the sidewall and the free end, the free end extending from the apex portion generally toward the flange and defining an opening between the free end and the flange;

the body is adapted to be positioned adjacent the roller track with the main member of the body adjacent the sidewall of the roller track opposite the interior space and the resilient member of the body in contact with the roller race opposite the flange; and the resilient member is shaped for generally contouring along the roller race and extending beyond the apex portion of the roller race in the direction of the free end of the roller race without interfering with the interior space or access to the opening of the elongate channel.

9. The position sensor assembly of claim 7 in which the resilient member includes a flexible thin section for substantially conforming to the shape of the roller track when the roller track is clamped between the resilient member and the jaw of the bracket to provide a contact area between the resilient member and the roller track sufficient to prevent the body and the bracket from slipping along the roller track.

10. The position sensor assembly of claim 7 in which the main member of the body includes a threaded hole, the position sensor assembly further comprising:

a threaded member for securing the resilient member against the roller track.

11. The position sensor assembly of claim 7 in which the one of the main member of the body and the outer leg portion of the bracket includes an angled portion in which the slot is located.

12. The position sensor assembly of claim 7 in which the main member includes a hole for receiving a fastener for fastening the body to the roller track.

13. The position sensor assembly of claim 7 in which the sensor includes a magnetically actuated electrical reed switch and the sensor actuating device includes a magnet.

14. The position sensor assembly of claim 7 in which the sensor is a proximity sensor.

15. The position sensor assembly of claim 7 in which:

the sensor includes a device for emitting a light beam and a device for sensing light; and the sensor actuating device is a reflector oriented for reflecting light toward the sensor.

16. A method of mounting a sensor to a roller track in the absence of fasteners, the roller track having an open side for guiding an overhead door and a closed side opposite the open side, the method comprising:

mounting the sensor to a body having a main member and a resilient member extending from the main member; and coupling the body to a bracket having an outer leg portion and a jaw extending in a direction transverse to the outer leg portion to clamp the roller track between the jaw and the resilient member of the body such that the body and the bracket are securely clamped to the roller track about the closed side without interfering with travel of the overhead door along the roller track.

17. The method of claim 16 in which:

one of the outer leg portion and the main member of the body includes a slot;

the other of the outer leg portion and the main member is sized to fit through the slot and includes serrations; and the coupling of the body to the bracket includes manually placing at least one of the serrations in ratchet-like engagement with an edge of the slot.

18. The method of claim 16 in which:

the roller track includes an open elongate channel having a sidewall, a flange, and a roller race defining an interior space, the flange and the roller race extending from the sidewall and spaced apart in opposed relation to form a unitary structure with the sidewall, the roller race having an apex portion and a free end, the apex portion located medially of the sidewall and the free end, the free end extending from the apex portion generally toward the flange and defining an opening between the free end and the flange;

the body is adapted to be positioned adjacent the roller track with the main member of the body adjacent the sidewall of the roller track opposite the interior space and the resilient member of the body in contact with the roller race opposite the flange; and the resilient member is shaped for generally contouring along the roller race and extending beyond the apex portion of the roller race in the direction of the free end of the roller race without interfering with the interior space or access to the opening of the elongate channel.

19. The method of claim 16 in which:

the main member of the body includes a slot;

the outer leg portion of the bracket is sized to fit through the slot and includes serrations; and the coupling of the body to the bracket includes the steps of:

positioning the body so that the resilient member is adjacent the roller race and the main member is adjacent the sidewall, and inserting the outer leg portion through the slot and squeezing the body and the bracket together about the roller track to deflect the resilient member and engage at least one of the serrations in ratchet-like manner with an edge of the slot.

* * * * *